US006871382B2

(12) United States Patent
Murayama et al.

(10) Patent No.: US 6,871,382 B2
(45) Date of Patent: Mar. 29, 2005

(54) DOOR CHECKER FOR AUTOMOBILE

(75) Inventors: Yuji Murayama, Saitama (JP); Takayuki Kubo, Saitama (JP); Takanori Usui, Saitama (JP); Toshio Takekata, Saitama (JP)

(73) Assignees: Rikenkaki Kogyo Kabushiki Kaisha, Saitama (JP); Honda Giken Kogyo Kabushiki Kaisha, Tokyo (JP)

( * ) Notice: Subject to any disclaimer, the term of this patent is extended or adjusted under 35 U.S.C. 154(b) by 49 days.

(21) Appl. No.: 10/642,501

(22) Filed: Aug. 18, 2003

(65) Prior Publication Data

US 2004/0111832 A1 Jun. 17, 2004

(30) Foreign Application Priority Data

Aug. 21, 2002 (JP) ..... 2002-240585

(51) Int. Cl.[7] ..... E05F 5/06

(52) U.S. Cl. ..... 16/82; 16/86 C; 16/86 B; 292/273; 292/277; 292/269

(58) Field of Search ..... 16/82, 86 B, 86 C, 16/85, 334, 332; 292/196, 273, 275, 262, 278, 277, 265, 269, DIG. 15, DIG. 57; 296/146.1, 146.11, 146.12

(56) References Cited

U.S. PATENT DOCUMENTS 5,173,991 A * 12/1992 Carswell ..... 16/86 A
5,727,287 A * 3/1998 Hosken et al. ..... 16/82
5,862,570 A * 1/1999 Lezuch et al. ..... 16/82
2003/0051312 A1 * 3/2003 Hoffmann et al. ..... 16/50
2004/0075285 A1 * 4/2004 Murayama et al. ..... 292/265

FOREIGN PATENT DOCUMENTS

EP 959210 A1 * 11/1999 ..... E05C/17/22
GB 2266338 A * 10/1993 ..... E05C/17/20
JP 58-20059 4/1989
JP 07117477 A * 5/1995 ..... B29C/45/14
JP 07144537 A * 6/1995 ..... B60J/5/04
JP 2002106237 A * 4/2002 ..... E05C/17/22
JP 2003118369 A * 4/2003 ..... B60J/5/04

* cited by examiner

*Primary Examiner*—Chuck Y. Mah
(74) *Attorney, Agent, or Firm*—Arent Fox, PLLC

(57) ABSTRACT

In a door checker for an automobile, including an intermediate recess which is formed in a side face of a check lever and deeper than a ball guide groove and into which a check ball is fitted by a biasing force of a check spring in order to generate a moderation resistance at a position of at least one medium opening degree of a door, the intermediate recess is formed so that a second opening width in a direction intersecting a centerline of the ball guide groove is larger than a first opening width along the centerline of the ball guide groove. Thus, the feeling of moderation upon fitting between the check ball and the recess is improved, and the generation of an abnormal sound during passing of the check ball through the recess by rapidly opening or closing the door is prevented.

2 Claims, 6 Drawing Sheets

START OF DROPPING

MIDDLE OF DROPPING

MIDDLE OF DROPPING

NO-LOAD STATE

START OF CLIMBING

DOOR CHECKER FOR AUTOMOBILE

BACKGROUND OF THE INVENTION

1. Field of the Invention

The present invention relates to a door checker for an automobile, and particularly to an improvement in a door checker for an automobile, comprising: a case secured to a door turnably supported on a body of an automobile; a check lever which is swingably supported on said body to extend through said case and which has a ball guide groove formed in its side face to extend in a lengthwise direction; a ball holder accommodated in said case and capable of being moved toward and away from the side face of said check lever; a check ball retained in said ball holder and capable of being rolled in said ball guide groove; and a check spring for biasing said ball holder toward said ball guide groove; said check lever having an intermediate recess which is formed in its side face and deeper than said ball guide groove, and into which said check ball is fitted by a biasing force of said check spring in order to generate a moderation resistance in a position of at least one medium opening degree.

2. Description of the Related Art

A conventional door checker for an automobile is disclosed, for example, in Japanese Utility Model Publication Laid-open No. 58-20059.

The intermediate recess in the check lever of the conventional door checker for the automobile forms a portion of a spherical surface having a diameter equal to or slightly larger than that of the check ball.

The setting of the diameter of the spherical surface corresponding to the intermediate recess in the check lever at the value substantially equal to that of the check ball, as described above, is effective for making clear a feeling of moderation at a predetermined medium opening degree at which the door should be stopped and retained and which is provided by the fitting between the recess and the check ball. However, this is one of causes which generate an abnormal sound when the check ball is passed through the intermediate recess by rapidly opening or closing the door.

More specifically, if the spherical surface corresponding to the intermediate recess and the check ball have substantially the same diameter, the check ball is brought into a no-load state due to the delay of the following of the check spring and the ball holder, the moment the check ball is dropped rapidly into the intermediate recess. Therefore, the check ball immediately collides with an upward slope of the intermediate recess due to an inertial force without reaching a bottom surface of the intermediate recess, and the resultant percussive noise resonates with the case and the door to generate an abnormal sound.

Therefore, if the diameter of the spherical surface corresponding to the intermediate recess is set at a value sufficiently larger than that of the check ball, the check ball reaches the bottom surface of the intermediate recess and climbs the upward slope of the intermediate recess, while being rolled on the upward slope, after the delay of the following of the check spring and the ball holder. Therefore, the generation of an abnormal sound due to the shock as described above does not occur. However, this is accompanied by a disadvantage that the feeling of moderation upon stopping and retaining the door at the predetermined medium opening degree is deteriorated in an amount corresponding to an increase in diameter of the spherical surface corresponding to the recess.

The present invention has been accomplished with such circumstance in view, and it is an object of the present invention to provide a door checker for an automobile, which can prevent the generation of an abnormal sound when the check ball is passed through the intermediate recess by rapidly opening or closing the door, while improving the feeling of moderation upon fitting between the check ball and the intermediate recess.

To achieve the above object, according to a first feature of the present invention, there is provided a door checker for an automobile, comprising: a case secured to a door turnably supported on a body of an automobile; a check lever which is swingably supported on said body to extend through said case and which has a ball guide groove formed in its side face to extend in a lengthwise direction; a ball holder accommodated in said case and capable of being moved toward and away from the side face of said check lever; a check ball retained in said ball holder and capable of being rolled in said ball guide groove; and a check spring for biasing said ball holder toward said ball guide groove; said check lever having an intermediate recess which is formed in its side face and deeper than said ball guide groove, and into which said check ball is fitted by a biasing force of said check spring in order to generate a moderation resistance in a position of at least one medium opening degree; wherein said intermediate recess is formed so that a second opening width in a direction intersecting a centerline of said ball guide groove is larger than a first opening width along said centerline of said ball guide groove.

With the first feature, the sectional shape of the intermediate recess along the centerline of the ball guide groove is formed substantially in correspondence to the sectional shape of the check ball, whereby the movement of the check ball in the direction along the ball guide groove while being fitted in the intermediate recess can be properly restrained by the intermediate recess, thereby providing a definite feeling of moderation to a user and preventing a large shaking of the door.

If the check ball is vigorously passed through the intermediate recess with the rapid opening or closing operation of the door, a distance of movement of the check ball in the intermediate recess can be ensured by the inertial force, even when the check ball is brought into a no-load state in the intermediate recess due to the delay of response of the check spring and the ball holder. As a result, the check ball is dropped onto a bottom surface of the intermediate recess by the retarded urging actions of the check spring and the ball holder, and then climbs an upward slope of the intermediate recess while being rolled on the upward slope. Thus, it is possible to avoid the collision of the check ball with upward slope of the intermediate recess to prevent the generation of an abnormal sound due to the collision.

According to a second feature of the present invention, in addition to the first feature, the intermediate recess is of a shape formed by elongating a recess formed by a portion of a virtual spherical surface having a diameter substantially equal to a diameter of the check ball, away from the center line of the ball guide groove in a direction intersecting the centerline.

With the second feature, the shape of the intermediate recess is simplified, and the intermediate recess can be formed easily. In addition, it is possible to reliably prevent the generation of an abnormal sound, while ensuring a good feeling of moderation.

DESCRIPTION OF THE PREFERRED EMBODIMENTS

First, a first embodiment of the present invention shown in FIGS. 1 to 6 will be described.

Figure 1:
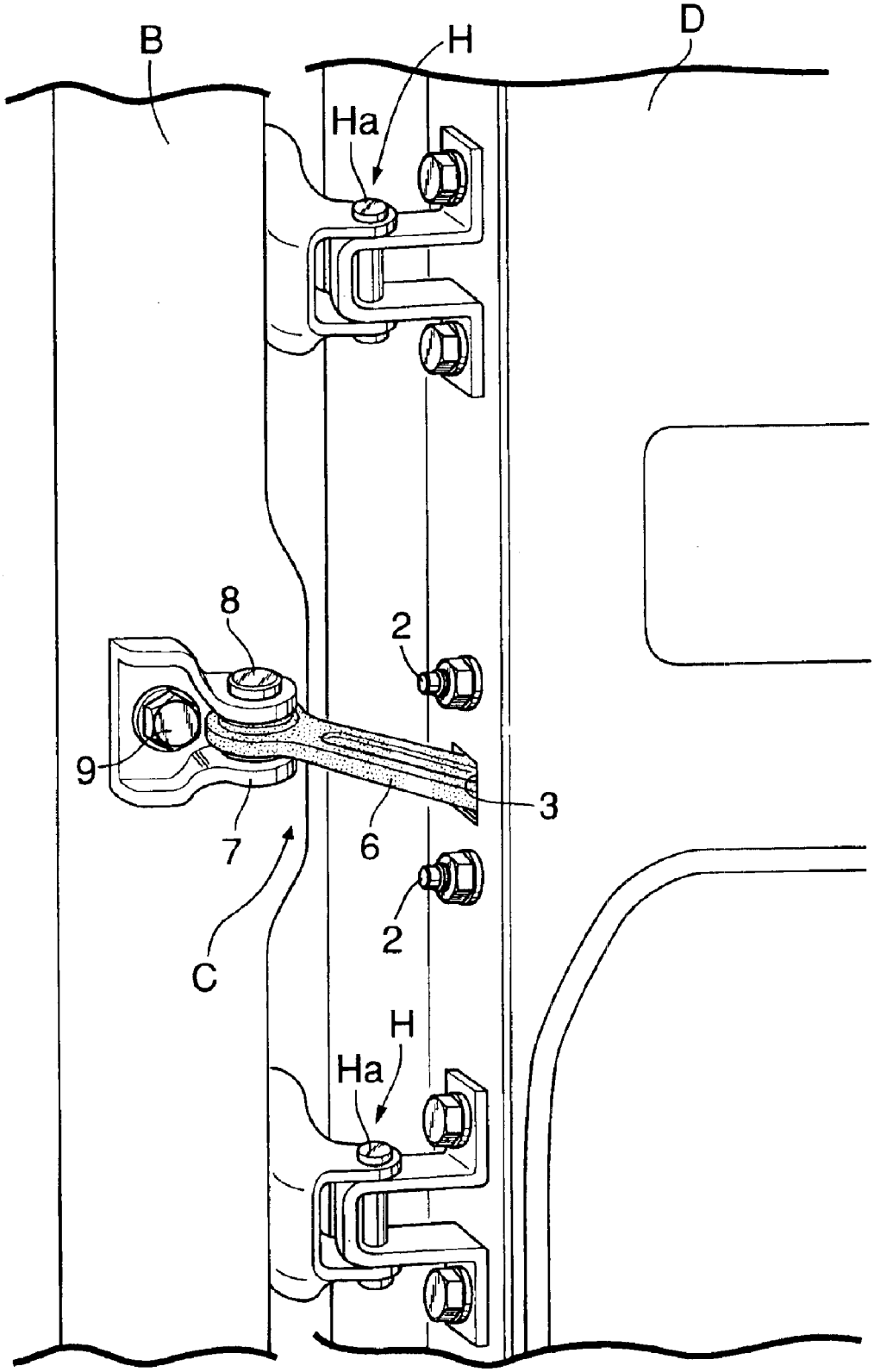
FIG. 1 is a perspective view of essential portions of an automobile provided with a door checker according to a first embodiment of the present invention.

In FIG. 1, a door D is turnably mounted on a body B of an automobile through a pair of upper end lower hinges H to open and close a doorway. A door checker C according to the present invention is mounted between the body B and the door D and between the hinges H.

Figure 2:
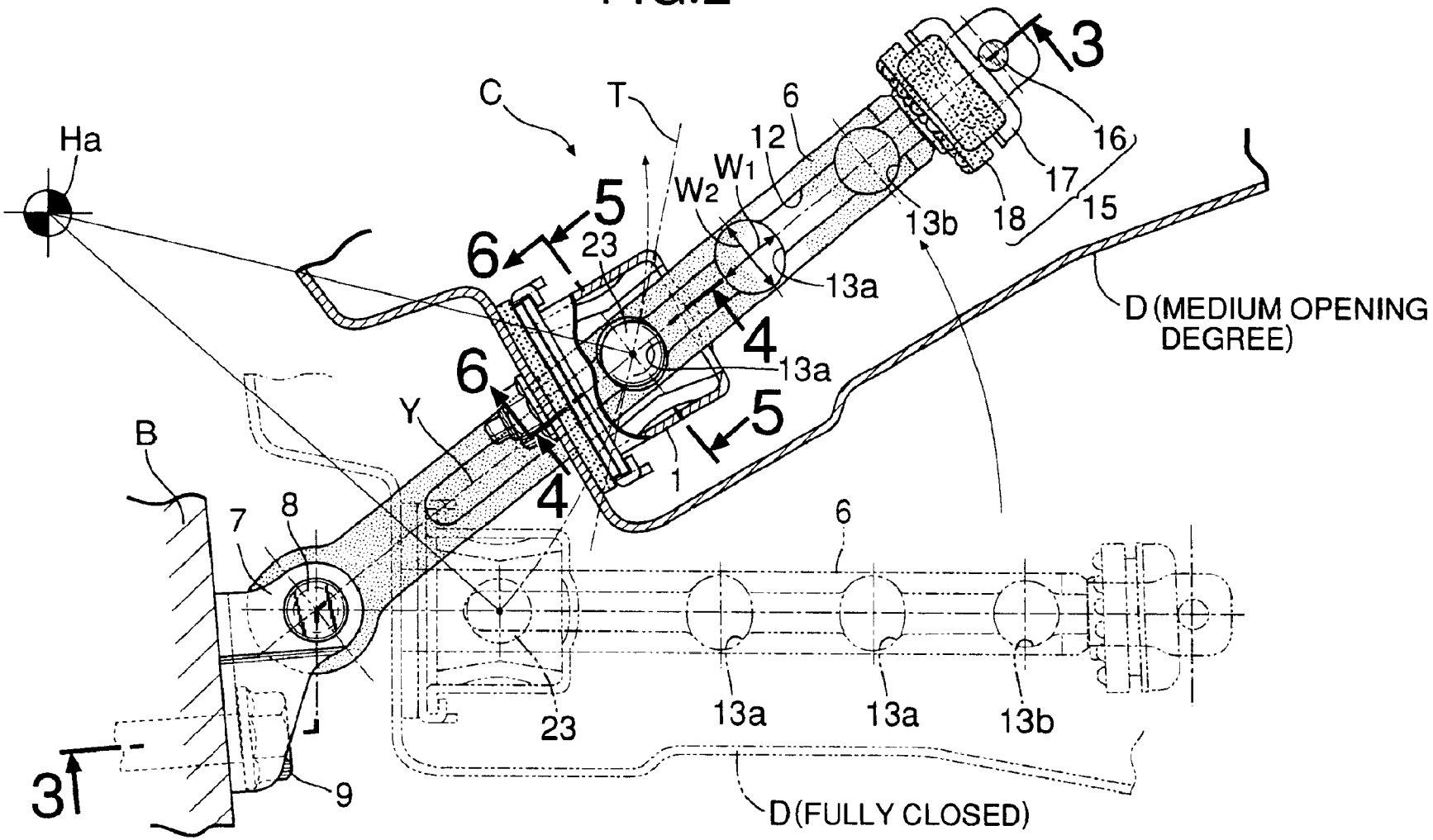
FIG. 2 is a plane view of the door checker.
Figure 3:
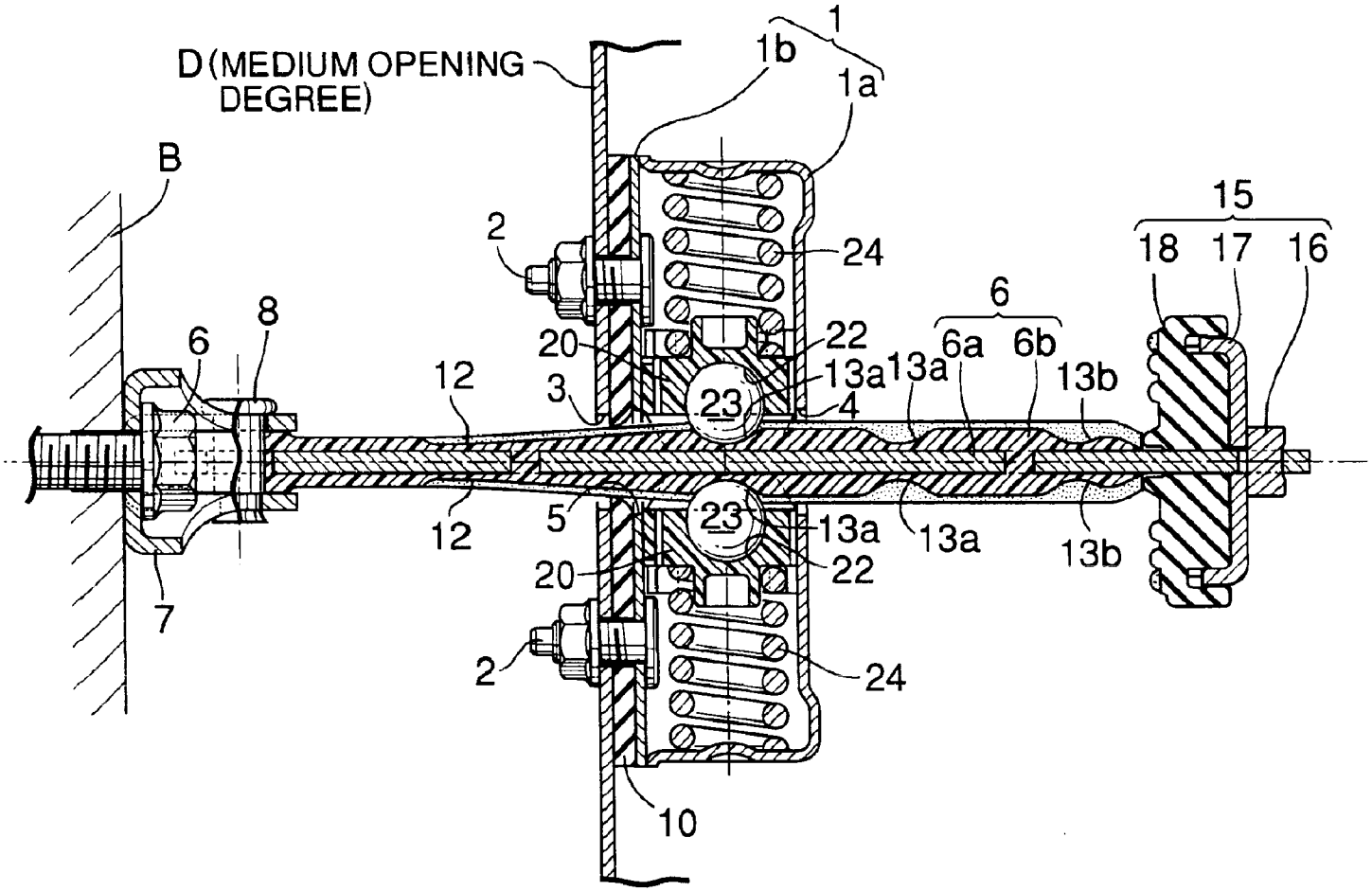
FIG. 3 is a sectional view taken along a line 3—3 in FIG. 2.

As shown in FIGS. 2 and 3, the door checker C has a case 1 secured by bolts 2 to an inner surface of and end wall of the door D. The case 1 comprises a box-shaped case body 1*a* opened at one end thereof, and a cover 1*b* coupled to the opened end. The cover 1*b* is secured to an inner wall of the door D by the pair of upper end lower bolts 2. The case body 1*a* and the cover 1*b* have through-bores 4 and 5 which are arranged coaxially with a through-bore 3 which opens into the end wall of the door D. A check lever 6 extends through the three through-bores 3, 4 and 5, and is relatively turnably connected at its base end to a bracket 7 through a pivot 8. The bracket 7 is disposed in parallel to pivots Ha of the hinges H and secured to the body B by a bolt 9. An elastic seal member 10 is clamped between the inner wall of the door D and the case 1 to come into slidable contact with an outer peripheral surface of the check lever 6, so that the entrance of a dust into the case 1 is minimized.

The check lever 6 is comprised of a plate body 6*a* made of a steel and connected to the bracket 7, and a covering portion 6*b* made of a synthetic resin and mold-coupled to an outer surface of the plate body 6*a* excluding its end opposite from the bracket 7. The covering portion 6*b* is formed so that the thickness of the check lever 6 is gradually increased from its base end (the side of the bracket 7) toward its free end. Ball guide grooves 12 arcuate in section are formed in opposite sides of the covering portion 6*b* to extend in a lengthwise direction of the check lever 6.

A pair of ball holders 20 are received in the case 1 for sliding movement in a thickness-wise direction of the check lever 6, and opposed to opposite sides of the check lever 6. A hemispherical ball housing 22 opens into an end face of each ball holder 20 opposed to the check lever 6. The ball 23 engaged in the ball guide groove 12 is rotatably accommodated in the ball housing 22. A coil-shaped check spring 24 is accommodated in the case 1 for biasing the ball holder 20 in a direction to engage the ball 23 with the ball guide groove.

A fully-opening stopper 15 is mounted to the plate body 6*a* to determine a limit of opening of the door D, i.e., a fully-opened position of the door D. The fully-opening stopper 15 is comprised of a stopper plate 17 made of a steel and secured to the plate body 6*a* by a pin 16, and a stopper rubber member 18 mounted to the stopper plate 17 to receive the door D in a buffering manner.

A plurality of (three in the illustrated embodiment) recesses 13*a* and 13*b* deeper than the ball guide groove 12 are formed in opposite side faces of covering the portion 6*b* and arranged along each ball guide groove 12, and the check ball 23 can be fitted into the recesses 13*a* and 13*b*. The recess 13*b* closer to the fully-opening stopper 15 is adapted to receive the check ball 23 at the fully-opened position of the door D, and the other two intermediate recesses 13*a* are adapted to receive the check ball 23 at predetermined positions of different medium-opening degrees of the door D. In the present invention, the former recess 13*b* is called a fully-opening recess, and the latter intermediate recess 13*a* is called an intermediate recess.

Figure 4:
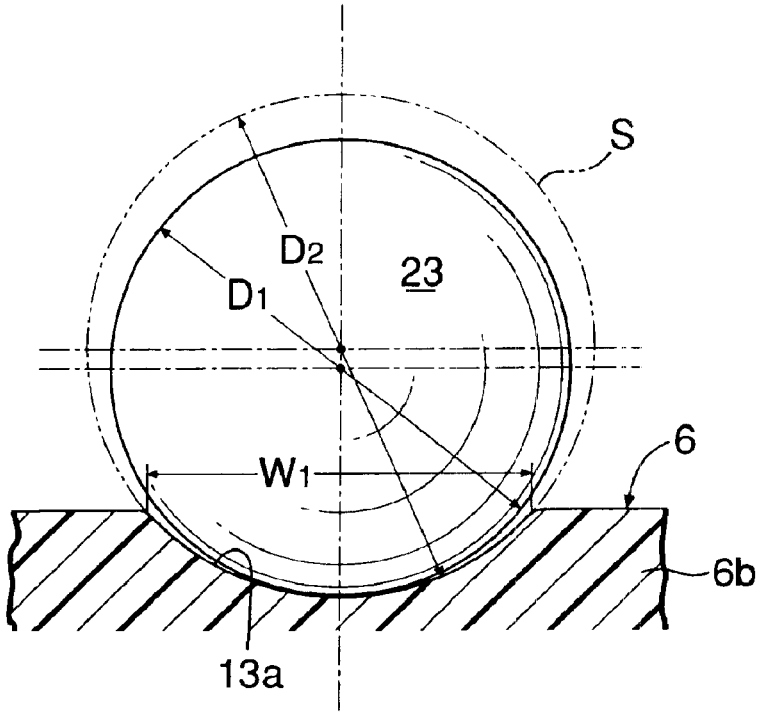
FIG. 4 is an enlarged sectional view taken along a line 4—4 in FIG. 2.
Figure 5:
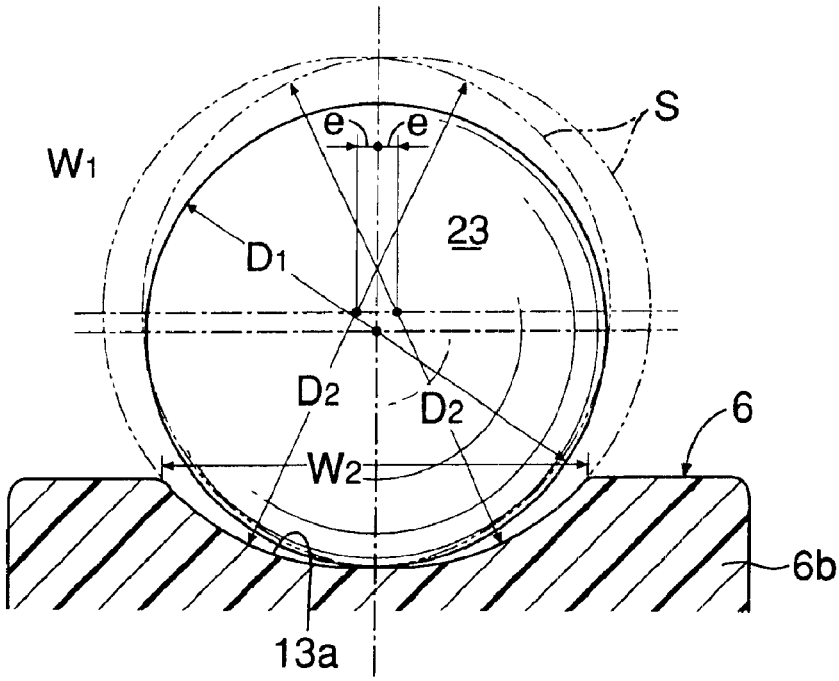
FIG. 5 is an enlarged sectional view taken along a line 5—5 in FIG. 2.

Especially, the intermediate recess 13*a* is formed into a shape shown in FIGS. 2, 4 and 5. More specifically, the shape of the intermediate recess 13*a* corresponds to a shape made by elongating a recess deeper than the ball guide groove 12 by distances e, e away from a centerline Y of the ball guide groove 12 in opposite directions perpendicular to the centerline Y, and formed by a portion of a virtual spherical surface S having a diameter $D_2$ equal to or slightly larger than a diameter $D_1$ of the check ball 23. Therefore, an opening of the intermediate recess 13*a* assumes such an elliptic shape that a second opening width $W_2$ in a transverse direction of the check lever 6 is larger than a first opening width $W_1$ along the centerline Y of the ball guide groove 12.

The fully-opening recess 13*b* may be of the same shape as the intermediate recess 13*a*, or may be of a shape forming a portion of a single virtual spherical surface having a diameter equal to or slightly larger than that of the check ball 23.

The operation of the first embodiment will be described below.

When the door D is opened from a closed state, the case 1 secured to the door D is moved away from the base end of the check lever 6, as the door D turns about the pivot Ha of the hinge H as shown in FIG. 2, whereby the check ball 23 is rolled, in a direction of increase of the thickness of the check lever 6, in the ball guide groove 12 in the check lever 6, while being rotated within the ball housing 22 of the ball holder 20. With this rolling, the check spring 24 is compressed, so that a clamping force of the check ball 23 on the check lever 6 is increased by an increase in resilient force of the check spring 24, whereby the opening torque for the door D is moderately increased.

When the door D has been opened to a medium opening degree, the check ball 23 is dropped and fitted into the first intermediate recess 13*a* by a biasing force of the check spring 24. Therefore, the door D can be retained at the first medium opening degree by a fitting force of the check ball 23.

In addition, if an opening force is applied to the door D, thereby allowing the check ball 23 to be moved out of the first intermediate recess 13*a* to turn the door D, the check ball 23 is fitted into the next intermediate recess 13*a* in the same manner as that described above, whereby the door D can be retained at a second medium opening degree.

When the opening force is further applied to the door D to open the door D to the fully-opened position in which the inner wall of the door D is in abutment against the stopper rubber member 18, the check ball 23 is fitted into the fully-opening recess 13*b* in the same manner as that described above, whereby the door D can be retained in the fully-opened position.

The sectional shape of the intermediate recess 13*a* along the centerline Y of the ball guide groove 12 is substantially the same as the sectional shape of the check ball 23, as shown in FIG. 4. Therefore, when the check ball 23 is fitted into the intermediate recess 13*a*, the movement of the check ball 23 in a direction along the ball guide groove 12 is properly restrained by the intermediate recess 13*a*. Thus, it is possible to provide a feeling of definite moderation to a user and to prevent the large shaking of the door D.

The operation, when the door D is rapidly opened from the fully closed state to the fully opened state to cause the check ball 23 to be passed vigorously through the intermediate recess 13*a*, will be described below with reference to FIGS. 2 to 6.

Figure 6A:
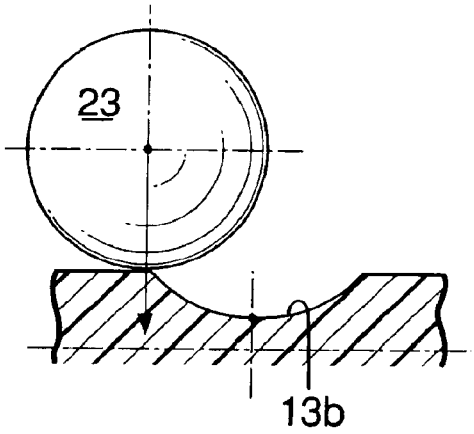
FIG. 6 is an enlarged sectional view taken a line 6—6 in FIG. 2 for explaining the operation.
Figure 6B:
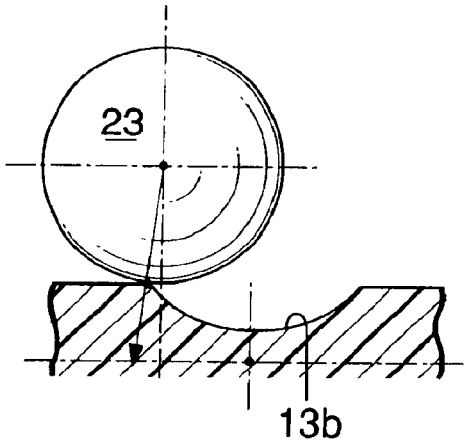
Figure 6C:
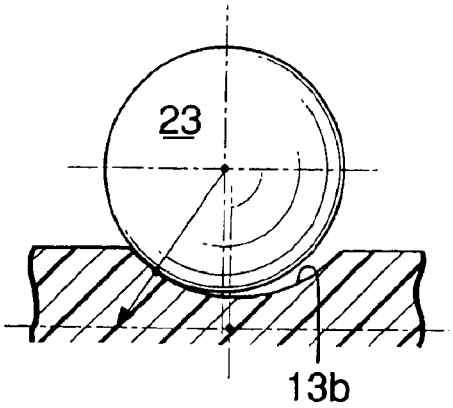
Figure 6D:
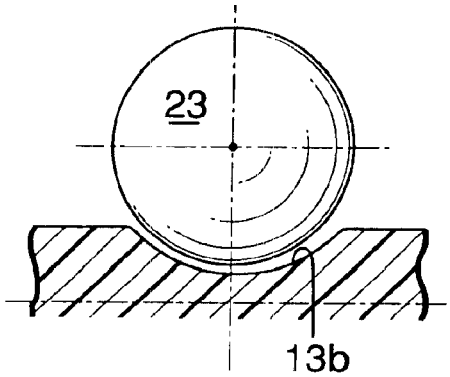

When the check ball 23 is started to be dropped into the intermediate recess 13*a*, as shown in FIGS. 6A to 6C, the check ball 23 is momentarily brought into a no-load state as shown in FIG. 6D due to the response delays of the check spring 24 and the ball holder 20. As a result, the check ball 23 is moved by an inertial force in a direction of an arcuate tangent line T about the pivot Ha of the hinge H, as shown in FIG. 2.

On the other hand, when the check ball 23 is brought into the no-load state and released from an urging force of the check ball 23, the turning of the check lever 6 is momentarily stopped by a resistance such as friction between the lever 6 and the pivot 8.

Figure 6E:
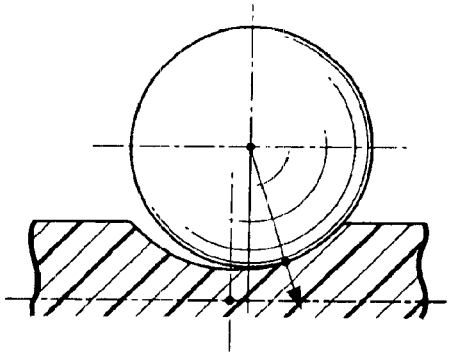

Therefore, the check ball 23 is advanced toward an upward slope of the intermediate recess 13*a* where the check ball 23 has been momentarily stopped. The check ball 23 lands on a bottom surface of the intermediate recess 13*a* without immediately colliding with the upward slope, and then climbs the upward slope, while being rolled on the upward slope, as shown in FIG. 6E, by retarded urging actions of the check spring 24 and the ball holder 20, because the intermediate recess 13*a* assumes the shape formed by elongating the recess formed by a portion of the virtual spherical surface S, by the distances e, e away from the centerline Y of the ball guide groove 12 in the opposite directions perpendicular to the centerline Y, as described above. In this manner, the collision of the check ball 23 with the upward slope of the intermediate recess 13*a* is avoided, so that the generation of an abnormal sound due to the collision can be prevented.

It is obvious that the collision of the check ball 23 with the upward slope of the intermediate recess 13*a* can be avoided by a function similar to that described above, even when the check ball 23 is passed through the intermediate recess 13*a* by rapidly closing the door D from the fully opened state.

Figure 7:
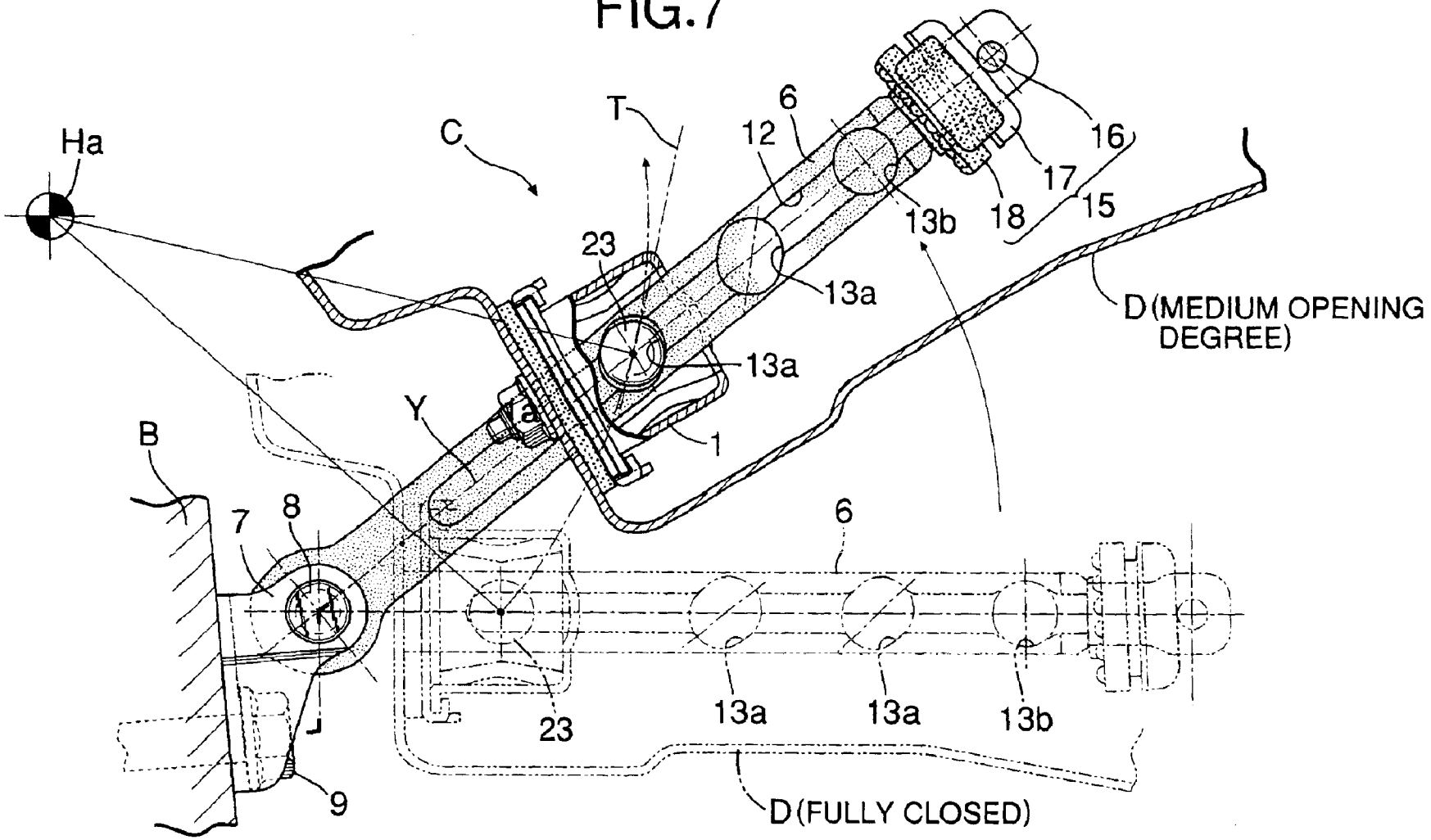
FIG. 7 is a view similar to FIG. 2, but showing a second embodiment of the present invention.

In a second embodiment of the present invention shown in FIG. 7, an intermediate recess 13*a* is of a shape formed by elongating a recess formed by a portion of the virtual spherical surface S, away from the centerline Y of the ball guide groove 12 in the tangent direction T obliquely intersecting the centerline Y. The arrangement of the other components is the same as that in the first embodiment, and hence portions or components corresponding to those in the first embodiment are designated by the same reference numerals and symbols in FIG. 7, and the description of them is omitted.

According to the second embodiment, a sufficient distance of movement of the check ball 23 in the tangent direction in a no-load state of the check ball 23 can be ensured, and the prevention of the generation of an abnormal sound can be effectively achieved.

The present invention is not limited to the above-described embodiments, and various modifications in design may be made without departing from the subject matter of the present invention. For example, the number of the intermediate recesses 13*a* may be one or plural. A rubber spring may be used in place of the coil-shaped check spring 24.

What is claimed is:

1. A door checker for an automobile, comprising: a case secured to a door turnably supported on a body of an automobile; a check lever which is swingably supported on said body to extend through said case and which has a ball guide groove formed in its side face to extend in a lengthwise direction; a ball holder accommodated in said case and capable of being moved toward and away from the side face of said check lever; a check ball retained in said ball holder and capable of being rolled in said ball guide groove; and a check spring for biasing said ball holder toward said ball guide groove; said check lever having an intermediate recess which is formed in its side face and deeper than said ball guide groove, and into which said check ball is fitted by a biasing force of said check spring in order to generate a moderation resistance in a position of at least one medium opening degree;

wherein said intermediate recess is formed so that a second opening width in a direction intersecting a centerline of said ball guide groove is larger than a first opening width along said centerline of said ball guide groove.

2. A door checker for an automobile according to claim 1, wherein said intermediate recess is of a shape formed by elongating a recess formed by a portion of a virtual spherical surface having a diameter substantially equal to a diameter of said check ball, away from the center line of the ball guide groove in a direction intersecting said centerline.

* * * * *